United States Patent [19]

Tricinella

[11] Patent Number: 4,949,600

[45] Date of Patent: Aug. 21, 1990

[54] COMBINATION POP-TOP CAN AND BOTTLE OPENER HAVING ENGAGING LIP

[76] Inventor: Bruce E. Tricinella, 17629 San Cristobal, Fountain Valley, Calif. 92708

[21] Appl. No.: 393,566

[22] Filed: Aug. 11, 1989

Related U.S. Application Data

[63] Continuation-in-part of Ser. No. 199,311, May 26, 1988, Pat. No. 4,864,898.

[51] Int. Cl.[5] ..... B67B 7/44

[52] U.S. Cl. ..... 81/3.09; 81/3.55

[58] Field of Search ..... 81/3.09, 3.27, 3.4, 81/3.55, 3.57; 7/151; 30/450

[56] References Cited

U.S. PATENT DOCUMENTS 1,199,272 9/1916 Hutter ..... 81/3.09 X 4,583,429 4/1986 Kroeger ..... 81/3.55

*Primary Examiner*—D. S. Meislin

*Attorney, Agent, or Firm*—Herb Boswell

[57] ABSTRACT

A combination pop-top can and bottle opener having an elongated lever body, a lifting element positioned on the lever body and sized and shaped to fit underneath a lift tab on a pop-top can, a fulcrum element formed on the lever body in physical association with the lift element but spaced away from the lift element to form a pop-top tab sheaving channel between the lift element and the fulcrum element, is improved by including an improved bottle cap edge gripper on the lever body. The edge gripper is formed to include one or both of a concave edge or a tongue. The tongue is tilted out of the plane of the remainder of the edge gripper. Further, opposing detents are formed on the gripper member to facilitate attachment of the gripper member to the lever body.

17 Claims, 2 Drawing Sheets

COMBINATION POP-TOP CAN AND BOTTLE OPENER HAVING ENGAGING LIP

CROSS REFERENCE TO RELATED APPLICATIONS

This application is a continuation in part of my prior application Ser. No. 199,311 filed May 26, 1988, entitled Combination Pop-Top Can And Bottle Opener, now U.S. Pat. No. 4,864,898 which issued Sept. 12, 1989. The entire contents of application Ser. No. 199,311 are herein incorporated by reference.

BACKGROUND OF INVENTION

This invention is directed to an improvement in a combination pop-top can and bottle opener. The improved opener has a modified edge on the bottle cap gripping member of the opener.

Two of the most popular ways of dispensing individual servings of beverages are in pop-top beverage cans and capped bottles. A modern pop-top beverage can utilizes a lift tab which is permanently attached to the lid of the can. In lifting the tab, an end of the tab depresses a section of the top of the can which is scored on three sides. The end of the tab presses the scored area inwardly into the can to form an opening in the can. Once the can has been opened the tab is bent back flat and flush against the top of the can allowing the contents of the can to either be poured out or to be removed from the can by drinking directly from the can.

While the above described pop-top cans are very convenient, certain individuals have difficulty in opening them. This includes, children and other individuals having small digits on their hands or weak hands, persons with diseased or injured hands and persons having long fingernails which they desire to remain in tact.

Person with long delicate fingernails or arthritic hands and the like sometimes attempt to open pop-top cans by wedging an instrument such as a spoon handle, fork or the like underneath the lift tab to initially raise this tab up from the top surface of the can. While at times this might be utilitarian and serve to lift the lift tab up from the top surface of the can it can scratch or mar the lifting instrument, inadvertently torque the lift tab to sever it from the top of the can or potentially slip from the top of the can resulting in inadvertent cuts, scrapes and the like.

Individual capped bottles of beverages generally are bottled in either a bottle which has a lift off cap which must be removed with an opener, or a screw off cap which theoretically can be removed by twisting off the top of the bottle. It goes without saying that the caps designed to be removed with an opener or other implement cannot be opened without that implement. With twist off caps the force necessary to remove the cap is such that the same group of individuals which have difficulty with pop-top cans also have difficulty in removing the twist off caps from bottles sealed with twist off caps. These persons must result to utilizing an opener or the like to remove the twist off cap.

A variety of openers suitable for removing the caps on bottles are known and used. These bottle cap openers however have little utility in opening pop-top cans. Attempts to use these implements to assist in opening pop-top cans is either ineffective, awkward or dangerous.

During the course of a days employment a bartender or other person who dispenses beverages may be required to open hundreds of pop-top cans and capped bottles. This continuous opening of pop-top cans can be very devastating to decorative fingernails and further it can be very irritating to the skin of the fingers because of the volume of lift tabs which must be manipulated.

BRIEF DESCRIPTION OF THE INVENTION

From the above it is evident that there exists a need for new and improved tools for assisting in opening of pop-top cans. Further, it is evident that there exists a need for new and improved tools which can be used for both opening pop-top cans and removing caps from capped bottles. In view of this it is a broad object of this invention to provide an improved combination pop-top can and bottle opener. These and other objects as will become evident from the remainder of this specification are achieved by improving a combination pop-top can and bottle opener of the type having an elongated unitary lever body with a portion of the lever body formed as an elongated planar lift element having its elongated axis coaxial with the elongated axis of the lever body and with a further portion of the lever body formed as a fulcrum element, the fulcrum element including a straight section and an arcuate section with the straight section located on the lever body in association with the lift element and spaced away from the lift element to define a lift tab sheaving channel between the lift element and the fulcrum element, and with the lift tab sheaving channel formed with walls which are parallel to one another and which are spaced apart from one another a distance to accept positioning of a pop-top lift tab between the walls, and with a further portion of the lever body formed as a web. The improvement includes utilizing a generally planar bottle cap gripping member independent of but fixedly joining to the lever body about the said lever body web. The gripping member has first and second side edges joined by a back edge and a lifting edge. The gripping member is formed of a material essentially impervious to deformation by an edge of a bottle cap. A lifting edge of the gripping member includes a bottle cap engagement means for engaging with the under side of the edge of a bottle cap.

The bottle cap engagement means can be formed by making the front edge of the gripping member concave in shape, by incorporating first and second notches in the same front edge and tilting the portion of the front edge of the member between the notches to form a tongue which projects from the plane of the remainder of the gripping member, or notching a concave edge and tilting material from such convace edge to form a tongue in the concave edge.

BRIEF DESCRIPTION OF THE DRAWINGS

This invention can be better understood when taken in conjunction with the figures wherein.

This invention utilizes certain principles and/or concepts as are set forth in the claims appended hereto. Those skilled in the packaging and utensil arts will realize that these principles and/or concepts are capable of being utilized by a variety of embodiments which may differ from the exact embodiments used for illustrative purposes herein. For this reason this invention is not to be construed as being limited solely to the illustrative embodiments, but should only be construed in view of the claims appended hereto.

DETAILED DESCRIPTION OF THE INVENTION

Figure 5:
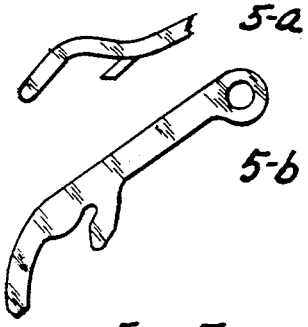
FIG. 5 PRIOR ART
FIG. 5 (5*a* and 5*b*) is a side elevational view of first and second prior art bottle cap removers.

FIG. 5*a* illustrates one end of a widely used bottle cap opener. This opener is formed on one end of steel implement which normal includes a can opener on its other end. A tang is punched or stamped from the center of the implement and bend out of the plane of the implement. While ubiquitous in their use, this type of opener tends to rust and it not of a size which can conveniently be carried in pocket or purse.

In FIG. 5*b* a further type of bottle opener is illustrated. This opener is formed of aluminum or an aluminum alloy and as such does not rust as does the above opener; however, because it is extruded from aluminum or an aluminum alloy the edges of the bottle caps it is used to remove soon abrade it, rendering it useless as well as potentially dangerous. This opener also includes a shallow notch for engaging a pop-top can lift tab; however, because this notch is very shallow it easily slips from the pop-top tab. Further this notch is located in that area of the opener which tends to be abraded by opening bottles. As this area wears, the opener becomes even less effective in assisting in opening pop-top cans.

Figure 1:
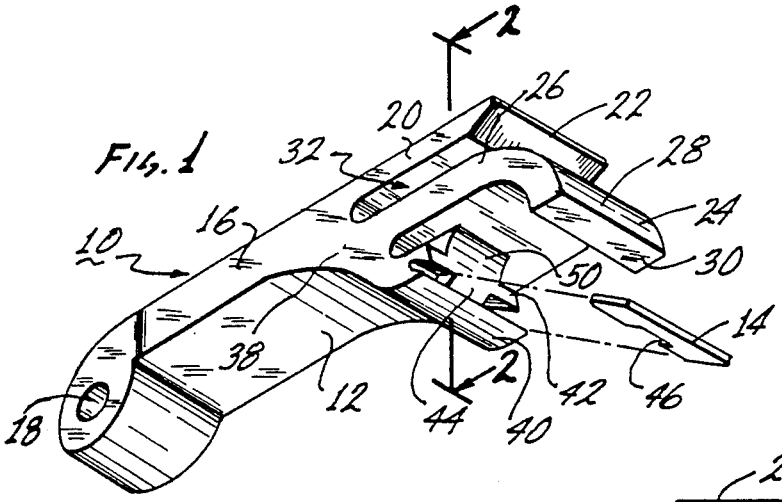
FIG. 1 is an exploded isometric view of a combination pop-top can and bottle opener showing the side, bottom and front of this opener.

A combination pop-top can and bottle opener 10 of the invention is capable of both opening a pop-top can and removing the cap from a capped bottle. The opener 10 is generally formed in two separate pieces of two separate materials. It includes a body 12 and an edge gripper plate 14. In FIG. 1 the edge gripper plate 14 is shown exploded away from the remainder of the body 12.

The body 12 is formed as a unified structure from a suitable material. Preferably it is formed of a polymeric material which when polymerized is strong and stiff and is incapable of bending or breaking during use. Suitable for forming the body 12 would be a polyamide as, for instance a nylon. This material is improved by incorporating fibers in the material for added strength against flexure. Thus, preferred for forming the body 12 would be a glass fiber filled nylon. Many commercial formulations of such fiber filled polymeric materials are available for use with common molding machines as, for instance, injection molding machines.

The edge gripper plate is preferably formed of a metal. Most useful because of its properties would be stainless steel. By utilizing stainless steel for forming the edge gripper plate 14, not only will the edge gripper plate 14 not rust, but it is also essentially impervious to deformation by the edges of bottle caps when it is pried against these edges. Many prior bottle openers are formed either of regular steel which tends to rust with use or of aluminum which is abraded by the edges of the bottle caps and thus limits the lifetime of such an aluminum bottle opener.

The body 12 of the opener 10 has a handle portion 16 which includes an eye 18 allowing for attachment of the opener 10 to a key ring, a chain or the like to assist in maintaining the opener 10 easily accessible to the user.

Extending from the handle 16 is a lift element 20. The lift element 20 includes a wedge surface 22 on its end.

The body 12 of the opener 10 is formed of an essentially elongated lever with this elongated structure continuing in the lift element 20. As such the lift element 20 is formed as an elongated planar surface which is capable of being slid underneath the lift tab of a pop-top can. The wedge surface 22 assists in positioning of the lift element 20 underneath the lift tab of the pop-top can.

A fulcrum element 24 is formed on the body 12 adjacent to the lift element 20. A first portion of the fulcrum element, a straight portion 26 extends essentially parallel to the lift element 20. The fulcrum element 24 then curves in an arcuate portion 28 away from the lift element 20. The end of the arcuate portion 28 culminates in engagement end 30 which fits against the center top of a cap when the opener 10 is utilized to open bottles.

The fulcrum element 24 and the lift element 20 are spaced apart from one another forming a channel 32 between them. The channel 32 is thus formed as an opening in the body 12. The inside walls of the channel 32 are parallel to one another and are spaced apart from one another a distance sufficient to allow for positioning or sheaving of the lift tab of a pop-top can between the lift element 20 and the fulcrum element 24 within the channel 32. Because the lift tabs of a pop-top can are flat planar structures and because the channel 32 is essentially formed as a flat planar opening the flat planar lift tab is snugly engaged, enveloped or sheaved within the channel 32 once the lift element 20 is slid underneath the lift tab.

Figure 3:
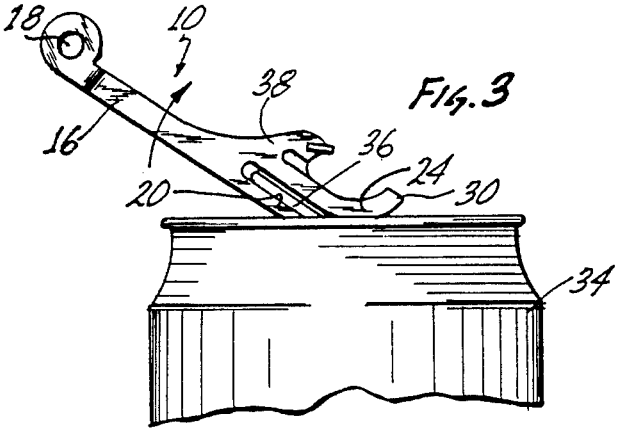
FIG. 3 is a side elevational view of a combination pop-top can and bottle opener showing the use of the opener in opening a pop-top can.
Figure 2:
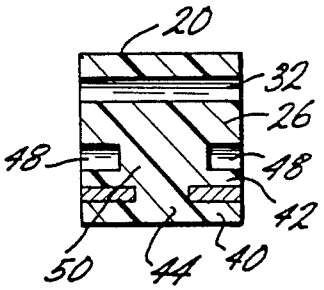
FIG. 2 is a sectional view about the line 2—2 of FIG. 1.

In FIG. 3 an opener 10 of the invention is being utilized to open a pop-top can 34. To open the can 34 the lift element 20 is slid underneath the lift tab 36 of the can 34. The wedge surface 22 assists in initially raising the lift tab 36 from the top surface of the can 34. Once the lift tab 36 is positioned in the channel 32 between the lift element 20 and the fulcrum element 24, the opener 10 is then rotated to lift the lift tab 36 and rotate it with respect to the top of the can 34 to open the can 34. Because the channel 32 is deep, of a dimension sufficient to sheave almost all of the lift tab 36 within it, the lift tap 36 will not slip or slide out of the channel 32. This prevents breaking off of the tab as can happen if the tab is twisted improperly by hand or with other implements. If the tap is broken off the can prior to opening the can, of course the contents of the can are unattainable.

Also, because the user of the can 34 does not have to initially pry the lift tab 36 from the surface of the can 34, the fingernails of the user are not in jeopardy of being broken and because of the mechanical advantage achieved with the opener 10, children and other individuals with weak or diseased hands can effectively open the pop-top can 34 with ease.

For opening bottles, in combination with the fulcrum element 24, the body 12 of the opener 10 includes an edge gripping plate foundation area 38. The foundation area 38 is formed as a projection of the body 12 which extends away from the elongated axis of the body 12. The area 38 includes a bottom lip 40 which is spaced away from a top lip 42 with a central web 44 located and extending between the lips 40 and 42.

The edge piece 14 is formed with a cutout 46 which is sized and shaped to be slightly undersized with respect to the thickness of the central web 44. The thickness of the plate of the edge piece 14 is essentially the same as that between the top and bottom lips 40 and 42. The edge piece 14 can be inserted over the central web 44 and forced onto the central web 44. Because the body 12 is made of a polymeric material there is certain cold flow of this material allowing for positioning and locking of the cutout 46 on the edge plate 14 over the central web 44 to permanently adhere the edge plate 14 to the body 12.

For ease in molding the body 12 cutout areas collectively identified by the numeral 48 are formed just above the top lip 42 to define a further web 50 which joins the foundation 38 to the fulcrum element 24.

Figure 4:
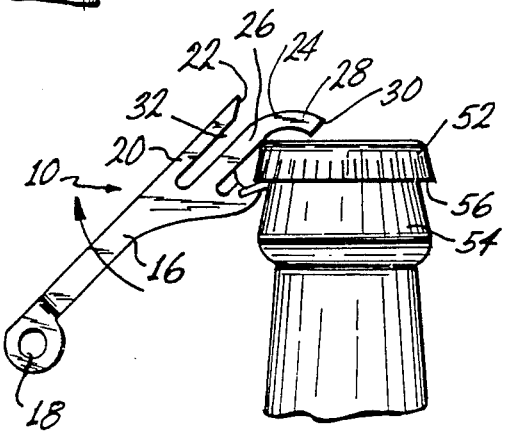
FIG. 4 is a side elevational view of a combination pop-top can and bottle opener showing the use of the opener in removing a bottle cap from a capped bottle.

In FIG. 4 the opener 10 of the invention is being utilized to remove a cap 52 from a bottle 54. To do so the edge plate 14 is located underneath the lip 56 of the cap 52 and the end of the fulcrum element 24 is positioned on top of the cap 52. Rotation of the opener 10 in a normal manner lifts the cap 52 from the bottle 54.

As so formed and constructed the opener 10 of the invention is utilitarian for opening both pop-top beverage cans and capped beverage bottles. Because the opener 10 is formed as a two piece opener utilizing a separate edge plate 14 from the body 12, advantage can be taken of both the metallic properties of the edge plate 14 for resisting wear in gripping a lip 56 of a cap 52 and the polymeric properties of the materials of the body 12 which are strong, sanitary and light weight.

Since the opener 10 is both small in size and does not have any sharp or protruding edges it can be conveniently carried in a pocket or purse without fear of either injury to ones body or ones clothing, purse or the like. Further, because of the shape of the opener 10, the only metallic component, i.e. the edge plate 14, is essentially recessed within the interior of the C shape formed by the fulcrum element 24 and the foundation area 38. This provides a safety feature compared to some other known metallic bottle openers.

Illustrated in FIGS. 6, 7, 8 and 9 are improved gripper plates or gripping members of the invention. These improved gripper plates or members can include an improved means to engage a bottle cap. A first of these bottle cap engagement means utilizes a concave edge to fit under the periphery of a bottle cap. A second of these bottle cap engagement means utilized separation of a portion an edge of the member and tilting it at an angle to the remainder of that edge. This forms a "tongue" like area along the edge of the gripping member.

The gripping member portion of the pop-top and bottle cap openers of the invention can also be improved by incorporating opposing detents within the cutouts which are utilized to attach the gripping member to the lever body. Such detents when fit over a web as, for instance web 50, firmly lock the gripping member to the web.

Figure 6:
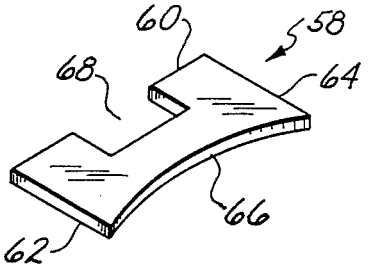
FIGS. 6, 7, 8 and 9 are isometric views of improved gripping members of the invention.

In FIG. 6 a first improved gripping member 58 is illustrated. Gripping member 58 is formed generally as a flat planar member from stainless steel or other similar deformation resistant material. It has a first edge, left edge 62, a second edge, right edge 64, a front edge 66 and a rear edge 68. A cutout area 68 is formed into the back edge 68 as was described for the member 14 above.

The front edge 66 of the member 58 is concave in shape when viewed along a line which is normal to the plane of the planar member 58. This concave shape is of a radius of about 0.875 inches. This is about the same radius of curvature as is a bottle cap. Because of this the total periphery of the edge 66 fits against the bottom of a bottle cap as, for instance cap 52, and against the neck of a bottle as, for instance bottle 54. As opposed to the flat edge of the member 14, the concave edge of the member 58 engages more of the surface area of the bottom edge of a bottle cap to facilitate removal of the same from a bottle.

Figure 7:
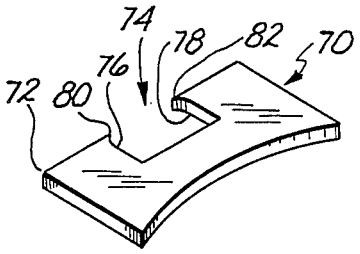
Figure 8:
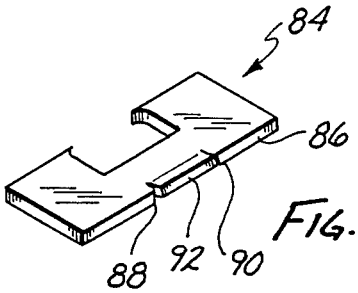

Shown in FIG. 7 is a further improved gripping member 70. The member 70 incorporates a concave front edge as was described for member 58. It has a back edge 72 with a cutout 74 formed therein. Additionally along its back edge 72 at the corners formed by side walls 76 and 78 of its cutout 74, first and second detents 80 and 82 are formed. The detents 80 and 82 are opposed to one another about the back edge 72.

When the member 70 is located over the web 50 of a lever body 12, the detents 80 and 82 "bite" into the material of the web to firmly engage the member 70 to the web.

Seen in FIG. 84 is a further improved gripping member 84. The member 84 has a straight front edge 86. First and second notches 88 and 90 are cut into the front edge 86. The portion of the edge 86 between the notches is titled or bent upwardly from the plane of the remainder of the member 84 to form a tongue 92. In removing a cap from a bottle, the tongue 92 engages the bottom edge of the cap to assist in removal of the same from the bottle.

Figure 9:
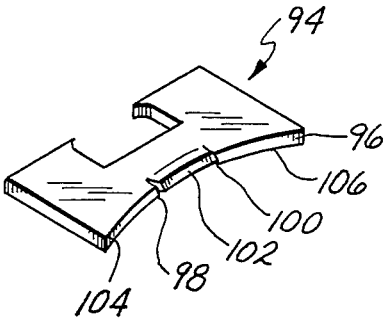

In FIG. 9 a further gripping member 94 is illustrated. The front edge 96 of member 94 is concaved as per members 58 and 70. In addition notches 98 and 100 are cut in edge 96 and tongue 102 is formed by bending or tilted the edge material between the notches 98 and 100 from the plane of the remainder of the member 94. As so formed the edge of the tongue 102 is concave as are the remaining area of the front edge 96, left area 104 and right area 106. This allows the front edge of the member 94 is be positioned closely adjacent a bottle neck with both areas 104 and 106 in contact with the bottle neck and with the tongue 102 located beneath the bottom edge of the bottle cap.

Both of the members 84 and 94 also incorporate detents (not separately numbered or identified) as per the member 70.

I claim:

1. In combination with a pop-top can and bottle opener of the type having a lever body formed as a unitary elongated body with an elongated planar portion of the lever body formed as a lifting element for fitting underneath a pop-top can lift tab on a pop-top can, the lifting element including a wedge surface for fitting between a pop-top can lift tab and the top surface of a pop-top can; a fulcrum element formed as a further portion of the elongated lever body, the fulcrum element for engaging either the top of a bottle cap or one surface of the pop-top lift tab, the fulcrum element including a straight section and an arcuate section with the straight section of the fulcrum element located in parallel planar association with the lifting element and joining the arcuate section to the remainder of the lever body, and the arcuate section of the fulcrum element curving away from the lifting element, a pop-top lift tab sheaving channel formed as an opening between the lifting element and the fulcrum element on the lever body, an improvement comprising:

a generally planar bottle cap gripping member independent of but fixedly joining to said lever body, said gripping member having first and second side edges joined by a back edge and a lifting edge;

said gripping member formed of a material essentially impervious to deformation by an edge of a bottle cap;

said lifting edge of said gripping member including a bottle cap engagement means for engaging with the under side of the edge of a bottle cap.

2. An improvement of claim 1 wherein:

said bottle cap engagement means includes said lifting edge formed as a concave edge.

3. An improvement of claim 1 wherein:

said bottle cap engagement means includes said lifting edge having first and second notches formed therein with the portion of said lifting edge located between said notches tilted out of the plane of the remainder of said gripping member.

4. An improvement of claim 1 wherein:

said bottle cap engagement means includes said lifting edge formed as a concave edge with first and second notches formed in said concave edge and with the portion of said concave edge located between said notches tilted out of the plane of the remainder of said gripping member.

5. An improvement of claim 1 wherein:

said back edge of said gripping member includes a cutout area extending in the plane of said gripping member towards said lifting edge; and said gripping member attaching to said lever body by locking said cutout area about a portion of said lever body.

6. An improvement of claim 1 including:

said back edge of said gripping member having a cutout area extending in the plane of said gripping member towards said lifting edge, said cutout having left and right side walls intersecting said back edge;

first and second opposing detent means located the intersection of said left and right side walls with said back edge; and said gripping member attaching to said lever body by positioning said cutout area about a portion of said lever body with said first and second detent means engaging said lever body.

7. An improvement of claim 1 wherein:

said gripping member is formed of a stainless steel plate.

8. A combination of claim 1 further including:

a portion of said lever body formed as a web; and said gripping member having a central cutout area therein, said gripping member attaching to said lever body by positioning of said gripping member cutout area onto lever body web.

9. An improvement of claim 8 further including:

said back edge of said gripping member having a cutout area extending in the plane of said gripping member towards said lifting edge, said cutout including left and right side walls intersecting said back edge;

first and second opposing detent means located the intersection of said left and right side walls with said back edge; and said gripping member attaching to said lever body by positioning said cutout about said lever body web with said first and second detent means engaging said lever body web.

10. In combination with a pop-top can and bottle opener of the type having an elongated unitary lever body with a portion of the lever body formed as an elongated planar lift element having its elongated axis coaxial with the elongated axis of the lever body and with a further portion of the lever body formed as a fulcrum element, the fulcrum element including a straight section and an arcuate section with the straight section located on the lever body in association with the lift element and spaced away from the lift element to define a lift tab sheaving channel between the lift element and the fulcrum element, and with the lift tab sheaving channel formed with walls which are parallel to one another and which are spaced apart from one another a distance to accept positioning of a pop-top lift tab between the walls, and with a further portion of the lever body formed as a web, an improvement comprising:

a generally planar bottle cap gripping member independent of but fixedly joining to said lever body about said lever body web, said gripping member having first and second side edges joined by a back edge and a lifting edge;

said gripping member formed of a material essentially impervious to deformation by an edge of a bottle cap;

said lifting edge of said gripping member including a bottle cap engagement means for engaging with the under side of the edge of a bottle cap.

11. An improvement of claim 10 wherein:

said back edge of said gripping member includes a cutout area extending in the plane of said gripping member towards said lifting edge; and said gripping member attaching to said lever body by locking said cutout area about said lever body web.

12. An improvement of claim 10 including:

said back edge of said gripping member having a cutout area extending in the plane of said gripping member towards said lifting edge, said cutout having left and right side walls intersecting said back edge;

first and second opposing detent means located the intersection of said left and right side walls with said back edge; and said gripping member attaching to said lever body by positioning said cutout area about said lever body web with said first and second detent means engaging said web.

13. An improvement of claim 10 wherein:

said bottle cap engagement means includes said lifting edge formed as a concave edge.

14. An improvement of claim 10 wherein:

said bottle cap engagement means includes said lifting edge having first and second notches formed therein with the portion of said lifting edge located between said notches tilted out of the plane of the remainder of said gripping member.

15. An improvement of claim 10 wherein:

said bottle cap engagement means includes said lifting edge formed as a concave edge with first and second notches formed in said concave edge and with the portion of said concave edge located between said notches tilted out of the plane of the remainder of said gripping member.

16. In combination with a pop-top can and bottle opener of the type having an elongated unitary lever body with a portion of the lever body formed as an elongated planar lift element having its elongated axis coaxial with the elongated axis of the lever body and with a further portion of the lever body formed as a fulcrum element, the fulcrum element including a straight section and an arcuate section with the straight section located on the lever body in association with the lift element and spaced away from the lift element to define a lift tab sheaving channel between the lift element and the fulcrum element, and with the lift tab sheaving channel formed with walls which are parallel to one another and which are spaced apart from one another a distance to accept positioning of a pop-top lift tab between the walls, an improvement comprising:

a generally planar bottle cap gripping member independent of but fixedly joining to said lever body;

said gripping member having a lifting edge;

said gripping member formed of a material essentially impervious to deformation by an edge of a bottle cap;

said lifting edge of said gripping member including a bottle cap engagement means for engaging with the under side of the edge of a bottle cap; and said bottle cap engagement means including said lifting edge formed as a concave edge.

17. In combination with a pop-top can and bottle opener of the type having an elongated unitary lever body with a portion of the lever body formed as an elongated planar lift element having its elongated axis coaxial with the elongated axis of the lever body and with a further portion of the lever body formed as a fulcrum element, the fulcrum element including a straight section and an arcuate section with the straight section located on the lever body in association with the lift element and spaced away from the lift element to define a lift tab sheaving channel between the lift element and the fulcrum element, and with the lift tab sheaving channel formed with walls which are parallel to one another and which are spaced apart from one another a distance to accept positioning of a pop-top lift tab between the walls, an improvement comprising:

a generally planar bottle cap gripping member independent of but fixedly joining to said lever body;

said gripping member having a lifting edge;

said gripping member formed of a material essentially impervious to deformation by an edge of a bottle cap;

said lifting edge of said gripping member including a bottle cap engagement means for engaging with the under side of the edge of a bottle cap; and said bottle cap engagement means including said lifting edge having first and second notches formed therein with the portion of said lifting edge located between said notches tilted out of the plane of the remainder of said gripping member.

* * * * *